United States Patent [19]

Beery

[11] 4,023,489

[45] May 17, 1977

[54] DOCUMENT ENDORSING CONTROL CIRCUITRY AND METHOD FOR MINIMIZING POWER CONSUMPTION REQUIREMENTS

[75] Inventor: Jack Beery, Farmington, Mich.

[73] Assignee: Burroughs Corporation, Detroit, Mich.

[22] Filed: Feb. 6, 1976

[21] Appl. No.: 655,790

[52] U.S. Cl. ..... 101/235; 101/245; 324/163; 101/426; 361/3

[51] Int. Cl.[2] ..... B41F 13/24

[58] Field of Search ..... 101/93.18, 93.19, 93.20, 101/93.21, 93.22, 212, 216, 233, 234, 235, 245, 53, 74, 91, 426; 324/162, 163, 164, 177, 178, 161; 340/201 P; 317/5

[56] References Cited

UNITED STATES PATENTS

| | | | |
|---|---|---|---|
| 3,335,661 | 8/1967 | Moschetti et al. | 101/235 |
| 3,438,323 | 4/1969 | Smitzer et al. | 101/233 |
| 3,527,965 | 9/1970 | Hawkins et al. | 324/163 X |
| 3,537,393 | 11/1970 | Hegi | 101/235 |
| 3,659,524 | 5/1972 | Beery et al. | 101/93.19 |
| 3,734,011 | 5/1973 | Williams | 101/235 |
| 3,742,299 | 6/1973 | Gane | 324/161 X |
| 3,764,888 | 10/1973 | Anderson | 324/161 X |
| 3,820,712 | 6/1974 | Oswald | 324/162 X |
| 3,830,154 | 8/1974 | Hegi et al. | 101/235 |

*Primary Examiner*—E. H. Eickholt

*Attorney, Agent, or Firm*—Larry Michael Jarvis; Kevin R. Peterson

[57] ABSTRACT

Electrical control circuitry for driving a rotational print head to initiate an endorsement on a single side of paper checks traveling past the print head at a relatively constant velocity, including a bistable device operatively connected to control a ramp generator for accelerating the print head at a relatively constant rate from a stopped position to a present printing velocity and then decelerating the print head to a rest state at the same relatively constant rate after completion of document endorsement. The circuitry responds to closely-spaced documents entering the endorser by interrupting the head during its deceleration mode and maintaining the head at its interrupted velocity for a certain time delay in order to reaccelerate the head back to printing velocity at the same relatively constant rate in time for proper endorsement.

16 Claims, 4 Drawing Figures

DOCUMENT ENDORSING CONTROL CIRCUITRY AND METHOD FOR MINIMIZING POWER CONSUMPTION REQUIREMENTS

BACKGROUND OF THE INVENTION

1. Field of the Invention

The present invention relates to mechanisms for providing a stamp or endorsement to a single side of a document, generally referred to as document endorsers, and more particularly to a method for controlling the rotational print head of such a mechanism in order to minimize power consumption requirements of the device.

2. Prior Art

It is well-known in the bank check sorting art to provide a document endorsing apparatus for normally endorsing the back side of checks as they are individually fed to a sorting apparatus. The most common type of endorsement mechanism employed are those having a document feed means and a rotational printing drum having an ink stamp affixed to the drum surface so that with each revolution of the drum the stamp is properly inked and brought into position such that the document and drum are moving at a similar rate to provide endorsement to the back of the check.

Originally, the rotational print head was constantly rotated such that the actual position of the endorsement was haphazardly placed on the back of the check. Thereafter the mechanism was provided with a means to accelerate the print head responsive to a document entering the endorser for placing the endorsement at a predetermined location on the check. But because the documents were randomly spaced as they moved along a track to the endorser, it was found necessary in order to keep the printing position uniform to accelerate the rotational print head to printing velocity and then decelerate the head back to zero velocity before a subsequent document entered the endorser. To perform the rapid acceleration and deceleration of the print head, energy consumption by the print head motor was relatively high making it necessary to utilize a motor having high power consumption requirements.

Thus, it would be highly welcome in the endorsing art to provide a control method allowing a less powerful motor operated with lower power consumption requirements to accomplish the proper placement of an endorsement to a single side of randomly spaced documents entering an endorser.

OBJECTS OF THE INVENTION

It is, therefore, an object of this invention to provide a method for document endorsing utilizing a less powerful rotational print head motor than heretofor required in the proper placement of an endorsement to a single side of randomly-spaced documents entering an endorser.

It is a further object of the present invention to provide an endorsing system which minimizes power consumption requirements in the endorsement of randomly-spaced, moving documents.

It is yet another object of the invention to provide control circuitry readily adaptable to existing endorsing structure.

SUMMARY OF THE INVENTION

The foregoing objects are accomplished by a control method and apparatus for driving a rotational print head of a document endorsing apparatus for placing an endorsement on a single side of randomly-spaced documents traveling past the print head at a constant velocity. Documents are sensed upstream in position to enter the endorser and the print head is responsively accelerated at a relatively constant rate until reaching a preset printing velocity for endorsement to take place. After the document has been endorsed, the print head is decelerated toward a zero velocity rest position at the same relatively constant rate as that of the acceleration for awaiting the sensing of a subsequent document. The method and apparatus permit endorsing of closely spaced documents where the print head will not have time to reach its rest position and then reaccelerate back to printing velocity at the same constant rate for proper placement of the endorsement. The simultaneous occurrence of the head decelerating and a subsequent positioning of a document to enter the endorser commands an interruption of the deceleration of the head and a re-acceleration of the head at a proper time at the same constant rate reaching its proper print velocity in proper timing to endorse the subsequent entering document.

BRIEF DESCRIPTION OF THE DRAWING

Other objects, features and advantages of the invention will be readily apparent from the following description of the preferred embodiment taken in conjunction with the appended claims and accompanying drawings in which:

DETAILED DESCRIPTION OF THE PREFERRED EMBODIMENT

Figure 1:
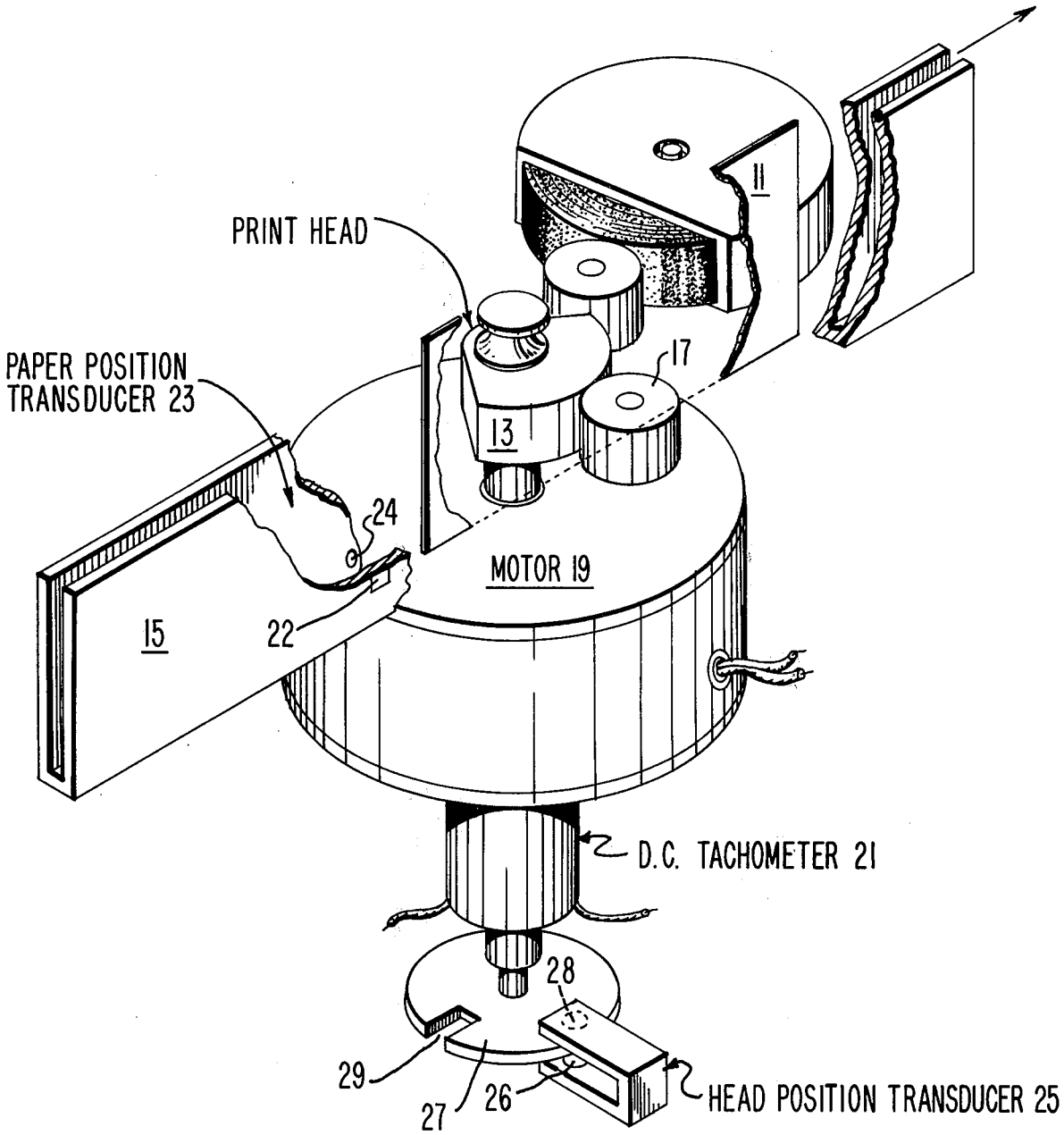
FIG. 1 is a perspective view of an elemental arrangement of a document endorser according to the present invention.

With reference to FIG. 1, there is shown a document endorsing apparatus wherein documents or checks 11 are guided into close proximity of a print head 13 for the placement of an endorsement or stamp onto the moving document. A guide track 15 serves to transport the checks 11 by moving belts or driving rollers (not shown) at a relatively constant velocity past the print head. A pressure roller 17, cooperates with the print head during the printing for holding the documents securely against the print head for check endorsement.

A D.C. motor 19 drives the print head, having its velocity monitored by a D.C. tachometer 21 utilized primarily in a speed control system to be described herein-after. In the preferred embodiment, as in nearly all high speed endorsers, the print head makes a single rotation for attaining print velocity and applying the endorsement. However, in a system where the print head may take two or more revolutions in reaching print velocity, the tachometer 21 may also serve to determine when the head has reached its optimum rate of rotation for printing to occur. The head must be rotated through an endorsing plane at substantially the same rate at which the document travels for the printing to be proper.

The print head 13 of the preferred embodiment is shaped to provide interference with pressure roller 17 during a portion of each revolution for printing of the endorsement. The pressure roller 17 is disposed in a substantially fixed position, but may be biasingly urged in an attitude toward the print head. Accordingly, printing may be initiated by other means as will suggest themselves to persons skilled in the art. For example, in conjuncton with desired timings and/or lengths of documents where the endorsing head must make two or more revolutions in reaching print velocity or print position, the printing may be initiated by movement of pressure roller 17 against the print head 13.

A paper position sensor or transducer 23 is disposed along the track 15 upstream from the print head for sensing the leading edge of a document moving into printing position. The sensor 23 comprises a light source 24 and a photocell sensing device 22 which responds to a break in the light to emit an electrical signal indicative thereof. Other sensing means including both mechanical or electrical and the placement thereof with respect to the print head (upstream, downstream, etc.) may be utilized to perform the function of sensing the presence of a document for the receiving of an endorsement by the print head.

The sensor 23 is positioned along the track a predetermined distance from the head, with the distance being determined according to the speed of the document, the speed of sensing by sensor 23, the time necessary for the print head to be accelerated to a proper print velocity, and the selected area of the check were the endorsement is to be applied. Thus, with the predetermined distance established between the sensor and the head, the sensor senses the leading edge of the document, the head responds to the sensed leading edge and accelerates to a preset printing velocity in time to apply the endorsement to a selected area on a single side of the check.

A head position transducer or sensor 25 is utilized to indicate that the endorsement is completed. A disk 27 carrying an aperture 29 is driven by the motor 19 in timed relation with the print head. A photocell sensing device 26 and light source 28 are arranged on opposite sides of the disk 27 for generating a signal when the aperture passes through the transducer 25 permitting the light source 28 to energize the photocell device 26. The width of aperture 29 is such to provide a short pulse of energization of the photocell device, and the location of the aperture with respect to the print head is such that the leading edge of the pulse occurs at substantially the time when the print head 13 leaves the check at the end of the endorsement.

Other sensor means may suggest themselves to those skilled in the art, which emit an electrical signal at the completion of the endorsement of the check. For example, the tachometer 21 may be utilized as the head position transducer in certain systems by emitting a signal a fixed time after the head has reached print speed. Further, the head position transducer 25 may operatively cooperate with the tachometer 21 to permit operation of the sensor 25 only during certain velocites, e.g., print velocity, where the particular system requires two or more revolutions of the print head in reaching print velocity.

Figure 2:
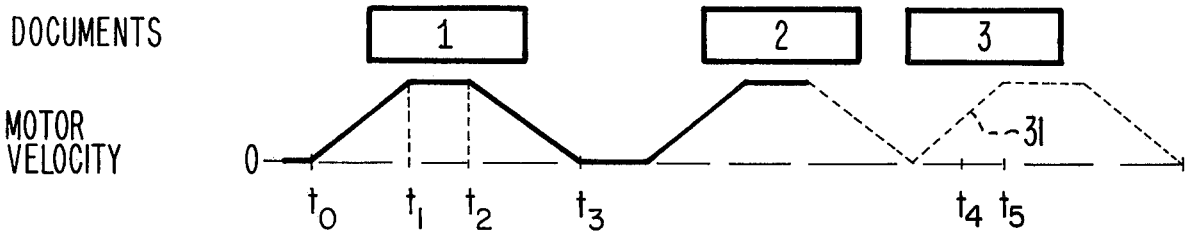
FIG. 2 is a timing diagram showing the velocity of a print head motor in relation to documents represented as being in proper endorsement position.

As shown in FIG. 2, a document No 1 is graphically related to the print motor velocity. Upon sensing a document upstream at $t_0$ the motor velocity increases at a relatively constant rate until reaching print velocity at $t_1$. The document should then be in position to receive an endorsement, after which at $t_2$ the motor decreases in velocity at the same constant rate as that of the velocity increase until reaching zero rest velocity at $t_3$. This constant rate of increase and decrease of velocity is related to the motor current and therefore is related to the power requirements necessary to operate the device.

But where the documents are closely spaced as depicted in FIG. 2 by documents No. 2 and No. 3, the slow rate of increase in velocity will not be sufficient to cause the motor to reach print velocity by the time document No. 3 is in position to receive an endorsement. This is illustrated by the dotted line 31 showing that as the motor velocity is slowly increased and decreased, the print head will reach its print velocity too late in time with respect to the position of document No. 3 in the printing plane. Thus, where an endorser is of the type that operates to apply an endorsement only when the document is in print position (time $t_4$), the head will not be at that position to endorse the document if its a single revoluton endorser, and if otherwise, the head will not be moving at its proper print velocity and may tear or jam the checks as the endorsement is applied; if on the other hand the endorser is of the type that operates to apply an endorsement only when the print head reaches proper velocity, either single rotation or otherwise, the endorsement will be printed at a different location on the check (at time $t_5$), or even miss endorsing the check altogether.

Figure 4:
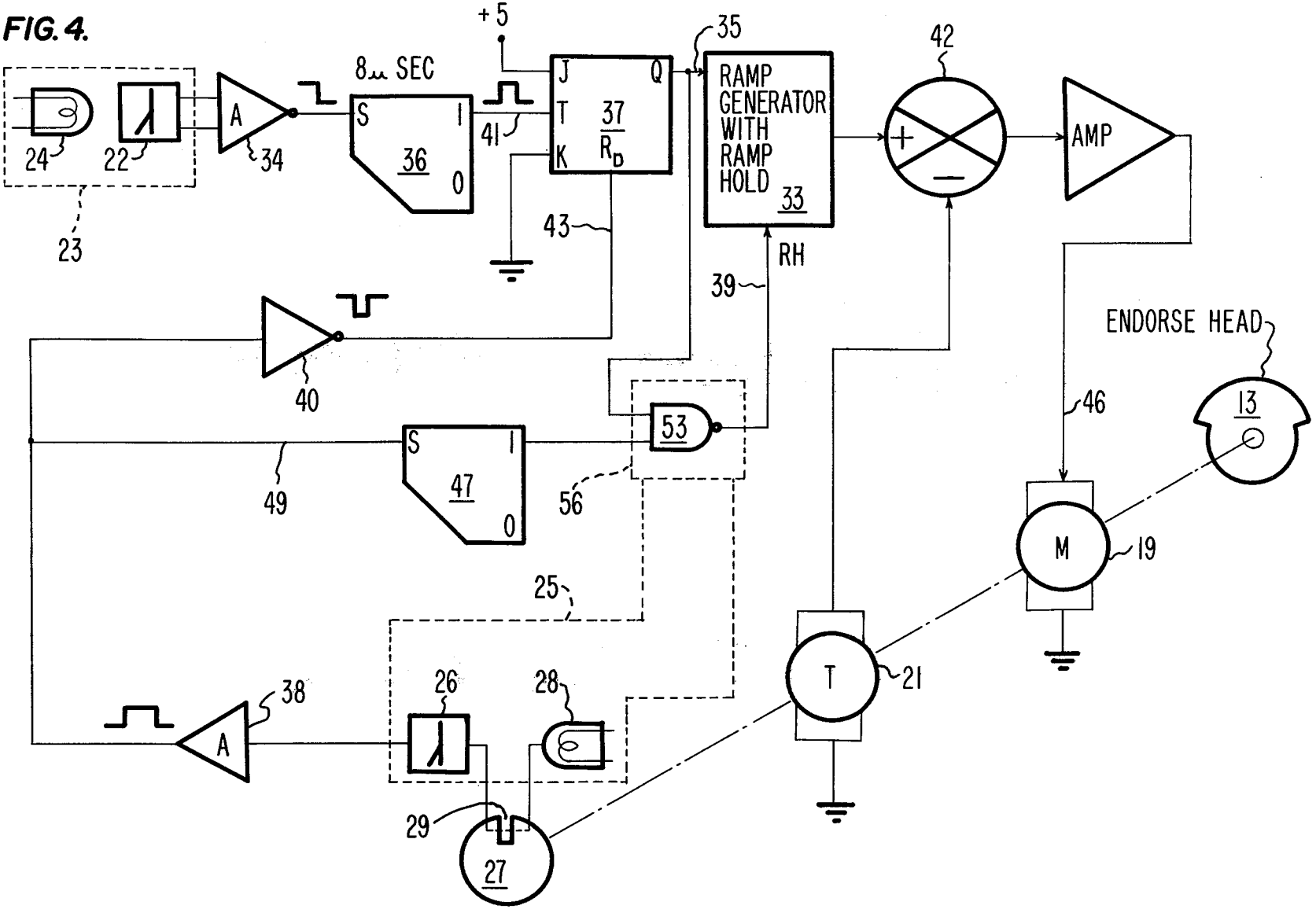
FIG. 4 shows a block diagram of electrical circuitry in accordance with the present invention.

The circuitry of the present invention as shown in FIG. 4 permits the motor to accelerate and decelerate as slowly as the specific system will permit, reaching print velocity in time for proper placement of the endorsement where documents are closely spaced. A ramp generator 33 is operative upon receiving an input signal over line 35 from the output of a bistable device of flip-flop 37 (FF 37) to produce an output for driving the endorsing head motor 19 at a velocity corresponding to the ramp output. The ramp genertor 33 provides a linear slope output that is positive going to a predetermined level upon a high voltage output from FF 37 and provides a linear slope output that in negative going to a zero level upon a low voltage output from FF 37. The predetermined level is set for a corresponding maximum speed desired from the motor 19, and the negative and positive slopes are of equal time duration set for the desired acceleration time of the system. Both the positive and negative slopes of the ramp generator must be within the torque capacity of the system.

The ramp generator further includes a ramp hold enabled by a pulse over line 39 to lock the ramp signal at a constant level at the level where the ramp hold is set. Ordinarily the ramp hold portion of a ramp generator is operated by a three-state device in conjuction with a capacitor. The capacitor is charged at a constant rate when a first state of the three-state device couples the capacitor to a positive voltage; the capacitor is discharged at a constant rate when a second state of the device couples the capacitor to ground; and the capacitor is stabilized when a third state of the device couples the capacitor to a disabled state. Other ways to produce a ramp generator having a ramp hold may be utilized as understood by those skilled in the art. In the preferred embodiment, the ramp hold is dominant over the input of the ramp generator.

A closed-loop speed control system is utilized to drive the motor 19 to follow a velocity profile of the output of ramp generator 33. The output of the ramp generator is connected to a summing point device or comparator 42, the output of which is fed to a linear amplifier for driving the motor 19 along line 46. The D.C. tachometer 21 provides a feedback signal to the comparator 42 corresponding to the measured speed of the motor. The measured speed signal is compared with the desired speed signal (ramp output) to produce an increase or decrease in motor speed depending upon the comparison made. In the preferred embodiment, the well known "T" type of servo motor control configuraton is utilized, however, the well known "H" type or other similar type may be used. Further, other circuitry may suggest themselves to persons skilled in the art to drive the motor 19 for following a velocity profile of the output of ramp generator 33. The tachometer 21 may be made to operate otherwise than D.C., including A.C. or digital, etc.

The bistable device 37 is considered to be a device having two stable output states: a high voltage level and a low voltage level. The state of the device is controlled by the paper position transducer 23 and the head position transducer 25. Sensing by paper position transducer 23 switches the bistable device 37 to a high state, and sensing by head position transducer 25 switches the bistable device 37 to a low state.

In the preferred embodiment, the bistable device is a JK flip-flop 37 having its J input connected directly to 5 volts keeping the J input high, and having its K input connected directly to ground keeping its K input low. A triggering or clock input T of FF 37 is pulse operable to switch the output Q of the FF to its high state The input T is kept at a low input voltage toggled by the trailing edge of a positive going pulse, i.e., when the T input changes from a high to a low input the output Q switches to a high state. Under normal operation the Q output will always be low prior to toggling of the T input.

A preset input $R_D$ of the FF 37 is operable to switch the output Q to its low state upon a low input to $R_D$. The input $R_D$ is kept at a high input voltage permitting operaton of the T input to switch the flip-flop, however, when $R_D$ input changes to a low input the output Q switches to a low state. Under normal operation the Q output will always be high prior to switching the $R_D$ input to a low state.

As understood by those skilled in the art, the JK flip-flop may be replaced by other bistable devices, e.g., an SR flip-flop operable to switch the output of the same by the S and R inputs operating in a similar manner as the preferred embodiment utilizes the T and $R_D$ inputs of a JK flip flop.

The input node T of FF 37 is operatively connected to the paper position transducer 23. Upon sensing a break in the light source 24, the photocell sensor 22 generates a signal change which is amplified by a "not" amplifier 34 for triggering a one-shot multivibrator 36. The one-shot 36 acts as a pulse standardizer for generating a short pulse having a width of approximately 8 micro sec. over line 41 to toggle the FF 37 in response to the sensing of a document moving to print position.

The input node $R_D$ of FF 37 is operatively connected to the head position transducer 25. As previously described the aperture 29 of disc 27 is utilized to form a short pulse output from photocell sensor 26 which is amplified by amplifier 38. The output from head position transducer 25 is changed to its negative by NOT gate 40 for keeping the input $R_D$ over line 43 high and to provide a negative going pulse to $R_D$ in response to sensing endorsement completion by transducer 25 to reset the FF output to a low state.

As seen in FIG. 4, the endorsing head 13, motor 19, tachometer 21 and disc 27 are all coupled to a shaft 18 to promote speed control and endorsement sensing by fixing the correlation of each to the reference shaft 18.

Figure 3:
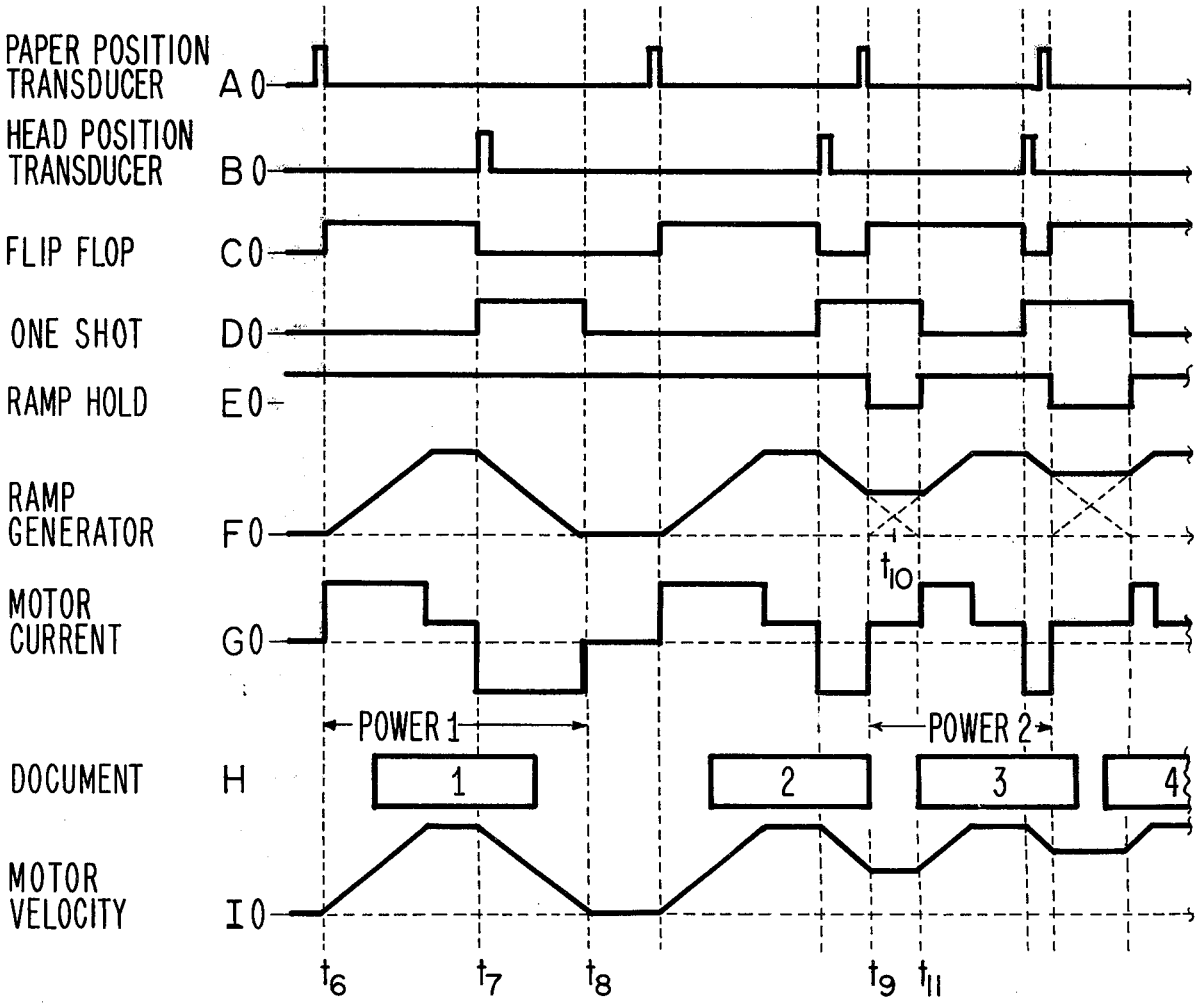
FIG. 3 shows a plurality of graphs labeled by the letters A through I, all of which are drawn to visually cooperate in a timing relationship, and each graph representing a particular functioning of electrical circuitry in accordance with the present invention.

To illustrate the operability of FF 37 in relation to sensing by transducers 23, 25, reference is now made to FIG. 3, wherein graphs A and B represent the output of the paper position transducer and head position transducer respectively, in relation to the documents Nos. 1, 2, 3, and 4 of graph H. The documents of graph H are represented as being in proper print position in the printing plane of the endorser for endorsement to occur. Thus, at time $t_6$ the paper position transducer has sensed the leading edge of the document No. 1 and one-shot 36 has generated a short pulse (graph A) the trailing edge of which sets the JK flip-flop to a high voltage state (graph C). After the completion of the endorsement to document No. 1 at time $t_7$, the head position transducer (graph B) has generated a short pulse resetting the JK flip-flop to its low out-put level (graph C).

Referring again to FIG. 4, a monostable multivibrator 47 is utilized in the control circuitry to indicate the time necessary for the ramp generator to ramp down from its predetermined level to a zero level, corresponding to the time of print head deceleration from the print velocity to zero velocity at a constant rate of deceleration. The monostate multivibrator (one-shot) receives signals over line 49 from the head position transudcer to set the one-shot to a constant voltage output lasting a predetermined time delay, after which the one-shot resets itself back to zero level output. (Graph D) of FIG. 3 illustrates the output of the one-shot and should be viewed in relation to graph B, the head position transducer.

The output of one-shot 47 and the output of FF 37 are fed to a device 56 which operates to produce an output which will be distinctive only if the inputs to the device 56 are both simultaneously high. In the preferred embodiment, the device 56 comprises a NAND gate 53 the output of which is fed over line 39 to the ramp hold of the ramp generator 33. The ramp hold is enabled only by a low output from NAND gate 53. Thus where flip-flop 37 and the one-shot 47 both have high outputs, the ramp hold will be triggered to fix the output of the ramp generator at that value when the ramp hold was initiated, and the ramp generator will be maintained at this value until the FF 37 and one-shot 47 no longer have simultaneous high outputs. A normal operation of the system is one in which the one-shot will go low first. The input to the ramp hold is illustrated in graph E of FIG. 3 and should be viewed in relation to (graphs C and D.) The graphs show that the ramp hold input is only low when both the flip-flops and one-shot are high.

The operation of the control circuitry may be described with relation to graph H of FIG. 3 illustrating several documents, 1, 2, 3, and 4. The documents 1–4 should be considered to be registered in the printing plane of the endorser in proper orientation for endorsement to occur. To promote discussion of FIG. 3, the relatively short duration of the switching pulses of graph A will be taken as negligible. Thus, the paper position transducer (graph A) senses the leading edge of document 1 at time $t_6$ generating a short pulse which sets flip-flop 37 (graph C). With the flip-flop 37 set, the ramp generator is enabled (graph F), driving the print head at a constant rate of acceleration to a preset velocity for printing to take place (graph I).

At time $t_7$ the head position transducer (graph B) senses endorsement completion and resets flip-flop 37 (graph C). When the flip-flop is in the reset position, the ramp generator (graph F) is signaled to decelerate the print head at a constant rate (graph I). The head position transducer also sets the one-short 47 (graph D) at $t_7$ to indicate the print head is decelerating. Without the immediate entrance of subsequent document into the endorser, the print head slows to a zero velocity and the one-shot lapses (time $t_8$).

Where the documents are closely spaced, a subsequent document may enter the endorser while the print head is decelerating as illustrated, for example, by documents 2 and 3 (graph H). At time $t_9$ document 3 enters the endorser and paper position transducer (graph A) emits a short pulse setting flip-flop 37 (graph C). At time $t_9$ the flip-flop 37 is set — indicating print head deceleration. The control circuitry responds to this condition via NAND gate 53 by pulsing the ramp hold (graph E) of the ramp generator to maintain the velocity of the print head at its present level (graph I). When the one-shot lapses at time $t_{11}$ (graph D), the ramp hold is extinguished (graph E) via NAND gate 53, permitting the print head to accelerate back to print velocity in response to the flip-flop 37 being in a high position. As illustrated by (graph I), the print head reaches its proper print velocity in relation to the proper position of the subsequent document No. 3 in the printing plane.

Graph G indicates the motor current necessary to drive the print head in relation to each of the documents 1, 2, 3, and 4 of graph H. The power utilized during each endorsement is a function of the motor current, and demonstrates that less power is consumed where documents are closely spaced as compared to the power required to endorse a single document. Thus, the control circuitry of the present invention provides less consumption of power and permits utilization of a less powerful motor not requiring rapid acceleration.

As illustrated by graph F of FIG. 3, between time $t_9$ and $t_{11}$ the circuitry of the preferred embodiment maintains the rotational velocity of the print head at a constant rate requiring little power as illustrated in graph G. Other embodiments within the scope of the present invention may permit the head to continue deceleration after time $t_9$, but the print head must be reaccelerated before time $t_{10}$ (graph F) where the graph line of acceleration and deceleration intersect, in order to permit the print head to reach proper velocity at the same constant rate of acceleration. By allowing the print head to decelerate after $t_9$ more power is consumed than by that of the preferred embodiment.

The head position transducer 25 must operate simultaneously or ahead of the paper position transducer 24. This then may control the minimum spacing between documents where the position of transducer 23 is fixed. But other circuitry may be incorporated in the preferred embodiment to sense less than minimum spacing between documents and to responsively maintain the print head at print velocity until the closely spaced documents are endorsed, after which the present embodiment would resume controlling the system.

As should be understood by those skilled in the art, the present invention encopasses motor control circuitry incorporated into the environment of controlling the print head of a document endorser. The circuitry is responsive to successive, irregularly occurring conditions between which a motor is accelerated to reach a certain velocity and may be maintained at that velocity for a certain time delay, or until the happening of a second type of event, upon which the motor is decelerated at a constant velocity toward a zero rest velocity in anticipation for a subsequent one of the irregularly occurring conditions. The circuitry as set forth compensates for the happening of a subsequent occurring condition during motor deceleration. Such control circuitry as set forth may be utilized in other environments, especially those dealing with document transportation, e.g., such circuitry could control document feed rollers for driving the same to a predetermined feed speed just prior to a moving document reaching the rollers and feeding the document therethrough, afterwhich the feedmotor could then be decelerated to a zero rest velocity.

It should be understood of course that the foregoing disclosure relates to preferred embodiment of the invention and that other modificatons or alterations may be made therein without departing from the spirit or scope of the invention as set forth in the appended claims.

What is claimed is:

1. In a document endorsing apparatus, a method of driving a rotational print head for endorsing successive documents moving therepast, comprising:
   - sensing individual documents of successive documents traveling along a path past a rotational print head;
   - driving the print head at a relatively constant rate of acceleration until reaching a predetermined print speed responsive to said sensing of an individual document;
   - endorsing the document when the print head is moving at said predetermined print speed;
   - sensing completion of said endorsing;
   - decelerating the print head at a relatively constant rate toward a zero speed responsive to sensing endorsement completion;
   - interrupting deceleration of the print head responsive to sensing a succeeding document and maintaining the speed of the print head at the speed when interrupted; and
   - accelerating the print head at a relatively constant rate until reaching said predetermined print speed responsive to a time delay after said interrupting, said time delay of sufficient magnitude to permit the head to accelerate to said predetermined print speed in time to endorse the succeeding document moving therepast.

2. The method of driving a rotational print head as recited in claim 1 wherein said constant rates of acceleraton and said constant rate of deceleraton are equal.

3. The method of driving a rotational print head as recited in claim 1 wherein said time delay is of a magnitude to permit the head to accelerate to said predetermined print speed in time to endorse a specified area of the succeeding document.

4. The method of driving a rotational print head as recited in claim 3 further including delaying said interrupting after said sensing of a succeeding document.

5. In a document endorsing apparatus a method of driving a rotational print head for endorsing successive documents moving therepast, comprising:

sensing individual documents of successive documents traveling along a path past a rotational print head;

driving the print head at a relatively constant rate of acceleraton until reaching a predetermined print speed responsive to said sensing of an individual document;

endorsing the document when the print head is moving at said predetermined print speed;

sensing completion of said endorsing:

decelerating the print head at a relatively constant rate toward a zero speed responsive to sensing endorsement completion;

interrupting deceleration of the print head responsive to a time delay after said sensing of a succeeding document, said interrupting performed by accelerating the print head at a constant rate until reaching said predetermined print speed, said time delay of sufficient magnitude to permit the head to accelerate to said predetermined print speed in time to endorse the succeeding document moving therepast.

6. The method of driving a rotational print head as recited in claim 5 wherein said constant rates of acceleration and said constant rate of deceleration are equal.

7. The method of driving a rotational print head as recited in claim 5 wherein said time delay is of a magnitude to permit the head to accelerate to said predetermined print speed in time to endorse a specified area of the succeeding document.

8. In a document endorsing apparatus having means to present successive documents in the proximity of a rotational print head and means for endorsing the document by the print head when the print head is rotating at a predetermined speed, a control system comprising:

first sensor means sensing individual documents of successive documents traveling along a path past a rotational print head to be endorsed;

second sensor means sensing the completion of endorsing the document by the print head;

drive means responsive to said first sensor means for driving the rotational print head at a constant rate of acceleration until reaching a predetermined speed, said drive means responsive to said second sensor means for driving the print head at a constant rate of deceleration from said predetermined speed toward a zero speed;

means indicating the time of print head deceleration from said predetermined speed to zero speed, said means initiated at beginning of print head deceleraton; and interrupting means responsive to said indicating means and said first sensor means of the simultaneous sensing of a succeeding document during print head deceleration, for inhibiting said drive means from accelerating the head responsive to said first sensor means, and for interrupting said deceleration of the print head and maintaining the rotational speed of the head at the speed when interrupted, said interrupting means deactivated responsive to said indicator means indicating completion of said deceleration, permitting actuation of said drive means responsive to said sensing of the succeeding document by said first sensor means.

9. The control system of claim 8 wherein said constant rate of acceleration and said constant rate of deceleration are maintained substanially equal.

10. The control system of claim 8 wherein said indicating means is responsive to said second sensor means and indicating for a fixed time corresponding to time of print head deceleration.

11. In a document endorsing apparatus having means to present successive documents in the proximity of a rotational print head driven by motor means, and means for endorsing the document by the print head when the print head is rotating at a predetermined speed, a control system comprising:

first sensor means sensing individual documents of successive documents traveling along a path past a rotational print head to be endorsed;

second sensor means sensing the completion of endorsing the document by the print head;

ramp generator means responsive to said first sensor means for producing a ramp-up output to a predetermined level and maintaining the output at said predetermined level, said ramp generator means responsive to said second sensor means for producing a ramp-down output from said predetermined level toward a zero output;

ramp hold means cooperable with said ramp generator means and operable for maintaining the output of said ramp generator means at the level when said ramp hold means is actuated, said ramp hold means inhibiting said ramp generator means from responding to said first sensor means until said ramp hold means is deactuated;

means connecting said output of said ramp generator means to a motor means for driving the rotational print head at a speed corresponding to the output of said ramp generator means;

means responsive to said second sensor means indicating the time of said ramp-down output from said predetermined level to a zero output;

interrupting means responsive to said indicating means and said first sensor means of the simultaneous sensing of a succeeding document during said ramp-down output, for actuating said ramp hold means, said ramp hold means deactuated responsive to said indicating means indicating a completion of said time, permitting actuation of said ramp generator means responsive to said sensing of the succeeding document by said first sensor means.

12. The control system of claim 10 wherin said ramp-up output and said ramp-down output have equal slopes.

13. In a document endorsing apparatus having means to present successive documents in the proximity of a rotational print head driven by motor means, and means for endorsing the document by the print head when the print head is rotating at a predetermined speed, a control system comprising:

first sensor means sensing individual documents of successive documents traveling along a path past a rotational print head to be endorsed;

second sensor means sensing the completion of endorsing the document by the print head;

a bistable device settable for producing an output of one of two states, said bistable device set to one state responsive to said first sensor means and set to other state responsive to said second sensor means;

ramp generator means having an input connected to the output of said bistable device, said ramp generator means responsive to said one state for producing a ramp-up output to a predetermined level and maintaining the output at said predetermined level, said ramp generator means responsive to said other state for producing a ramp-down output from said predetermined level toward a zero output;

ramp hold means cooperable with said ramp generator means and operable for maintaining the output of said ramp generator means at the level when said ramp hold means is actuated, said ramp hold means dominant over said input to said ramp generator means;

means connecting said output of said ramp generator to a motor means for driving the rotational print head at a speed corresponding to the output of said ramp generator means;

one-shot pulse generator means actuated responsive to said second sensor means for producing a pulse output having time duration equal in time to the time required for said ramp generator means to ramp to zero output from said predetermined level;

means receiving the output of said bistable device and the output of said pulse generator means for producing a distinctive output from the simultaneous input of said one state and said pulse output, the output of said means connected to said ramp hold means for actuation thereof by said distinctive output.

14. The control system of claim 10 wherein said ramp-up output and said ramp-down output have equal slopes.

15. In a document endorsing apparatus having means to present successive documents in the proximity of a rotational print head driven by motor means, and means for endorsing the document by the print head when the print head is rotating at a predetermined speed, a control system comprising:

first sensor means sensing individual documents of successive documents traveling along a path past a rotational print head to be endorsed;

second sensor means sensing the completion of endorsing the document by the print head;

voltage function generator means responsive to said first and second sensor means for producing a predetermined voltage profile; and drive means connecting the output of said voltage function generator means to a motor means for driving the rotational print head in conformance with said voltage profile.

16. The control system of claim 15 wherein said drive means includes a closed loop voltage control system.

* * * * *

UNITED STATES PATENT OFFICE

CERTIFICATE OF CORRECTION

PATENT NO. : 4,023,489

DATED : May 17, 1977

INVENTOR(S) : Jack Beery

It is certified that error appears in the above-identified patent and that said Letters Patent are hereby corrected as shown below:

In the Abstract, line 7 "present" should be --preset--;
Column 4, line 24 "revoluton" should be --revolution--;
Column 4, line 42 "genertor" should be --generator--;
Column 4, line 45 "in" should be --is--;
Column 6, line 35 "transudcer" should be --transducer--;
Column 7, line 23 should read --time $t_0$ the flip-flop 37 is set - indicating document 3's entrance, and the one-shot (graph D) is high - indicating print head --;
Column 8, line 4 "encopasses" should be --encompasses--;
Column 10, line 55 "wherin" should be --wherein--.

Signed and Sealed this

Twentieth Day of September 1977

[SEAL]

Attest:

RUTH C. MASON
Attesting Officer

LUTRELLE F. PARKER
Acting Commissioner of Patents and Trademarks